United States Patent [19]

Jones

[11] 4,424,025

[45] Jan. 3, 1984

[54] GAS FORGE

[76] Inventor: Donald R. Jones, Rte. 1, Box 343, Pleasant Garden, N.C. 27313

[21] Appl. No.: 368,627

[22] Filed: Apr. 15, 1982

[51] Int. Cl.[3] ..... F24J 3/00; B21J 19/00; F23D 13/24; F23C 5/08

[52] U.S. Cl. ..... 432/120; 110/195; 122/6.7; 431/178; 431/186; 431/189; 431/343; 432/231; 432/250

[58] Field of Search ..... 432/120, 224, 231, 250; 110/195; 122/6.7; 431/178, 186, 189, 343

[56] References Cited

U.S. PATENT DOCUMENTS

| | | | |
|---|---|---|---|
| 976,268 | 11/1910 | Kunkel | 431/189 |
| 1,768,002 | 6/1930 | Robeson | 432/231 |
| 2,448,723 | 9/1948 | Mayer | 432/250 |
| 3,357,474 | 12/1967 | Pivonka | 431/240 |
| 3,357,474 | 12/1967 | Pivonka | 158/53 |
| 3,486,497 | 12/1969 | Pivonka | 126/271.2 |
| 3,589,693 | 6/1971 | Wolf | 431/178 |
| 4,115,051 | 9/1978 | Bjerklie | 432/250 |

OTHER PUBLICATIONS

Brochure from "The Horseshoe Store", Spring 1982, 1754 Angela Street, San Jose, California 91525.

Brochure from NC Tool Company, (undated), Rte. 1, Box 343, Pleasant Garden, North Carolina 27313.

*Primary Examiner*—John J. Camby

[57] ABSTRACT

The present invention consists of a forge for heating horseshoes or the like to enable a blacksmith to shape and form metal objects. The forge or oven includes a gas burner which is positioned to maximize the heating capabilities of the oven while utilizing a minimum of gas fuel.

6 Claims, 3 Drawing Figures

GAS FORGE

BACKGROUND AND OBJECTIVES OF THE INVENTION

Small gas forges have been used for years by modern blacksmiths to heat horseshoes and other metal objects prior to forming. Gas forges or ovens generally provide a convenient source of heat which is clean and until recent years has been fairly economical. However, with the recent rise in the cost of both propane and natural gas, users of these forges have been very conscious of the efficiency of the ovens since their cost for shoeing horses must reflect the expense of the supplies used which includes the cost of the natural or propane gas fuel.

Generally, conventional gas forges consisted of one or more gas burners which were encased within the oven which usually had an open side to allow sufficient air to support and maintain combustion of the fuel. Ovens of this type require an excess of fuel to maintain the high temperatures needed and oftentimes blowers and other devices were utilized to increase the air supply. Of course the open-sided gas ovens, while allowing air to enter also allowed the heated air to escape. Also, users of the open-sided forges had to be careful not to burn themselves when working in the vicinity of the forges since the escape of the hot gases from within the forge posed a constant safety hazzard.

With the disadvantages of conventional gas forges well recognized, the present invention was developed and one of its objectives is to provide a gas forge with an external burner for efficient heating.

Another objective of the present invention is to provide a gas forge having a heating chamber in which the hottest point of the gas flame is focused.

Another objective of the present invention is to provide a gas oven which is efficient and economical to operate.

Yet another objective of the present invention is to provide a forge with a hingeable door to control the rush of hot gases escaping therefrom.

Other objectives and advantages of the present invention will be shown and understood from the details given below.

DESCRIPTION OF THE PREFERRED EMBODIMENT

The preferred form of the present invention includes a forge having a housing surrounding a heating chamber. A pair of gas burners are positioned externally of the housing for directing flames through openings in the top of said housing into the heating chamber. A hingeable door is provided on the front of the forge and an adjusting means allows the door to be partially closed as needed.

The gas burners are adjustably positioned on an inverted u-shaped bracket which attaches to the top of the housing, said burners being vertically adjustable whereby the hottest part of the flames from the burners can be positioned to reach approximately the center of the heating chamber. The burners include a cylindrically shaped perforated cover for directing the flames into the heating chamber for maximum heating efficiency.

SUMMARY OF THE INVENTION

The invention presented herein includes a forge having an external housing and an internal heating chamber. A gas burner is outwardly adjustably spaced from the housing whereby a flame from the burner is directed through an opening in the housing and into the heating chamber. A door means is hingeably positioned on the upper part of the housing and can be raised or lowered over the frontal opening to insert and extract objects from the heating chamber. In use, the blacksmith ignites the gas burner, adjusts the flame and then raises the door means and inserts the horseshoe or other object to be heated. The hingeable door is then closed to a desired position by the use of an adjusting means positioned on said door means. When the object inside reaches the desired temperature the door means is then opened and the horseshoe extracted for forming and cooling. The gas burner has a cylindrical perforated cover member which is rotatably received that allows the cover member to adjust the flame configuration as with conventional gas burning tools such as propane torches. By adjusting the flame configuration and adjusting the distance of the burner from the housing, the inner flame of the burner can be focused to an exact location for maximum heating efficiency within the heating chamber.

Figure 1:
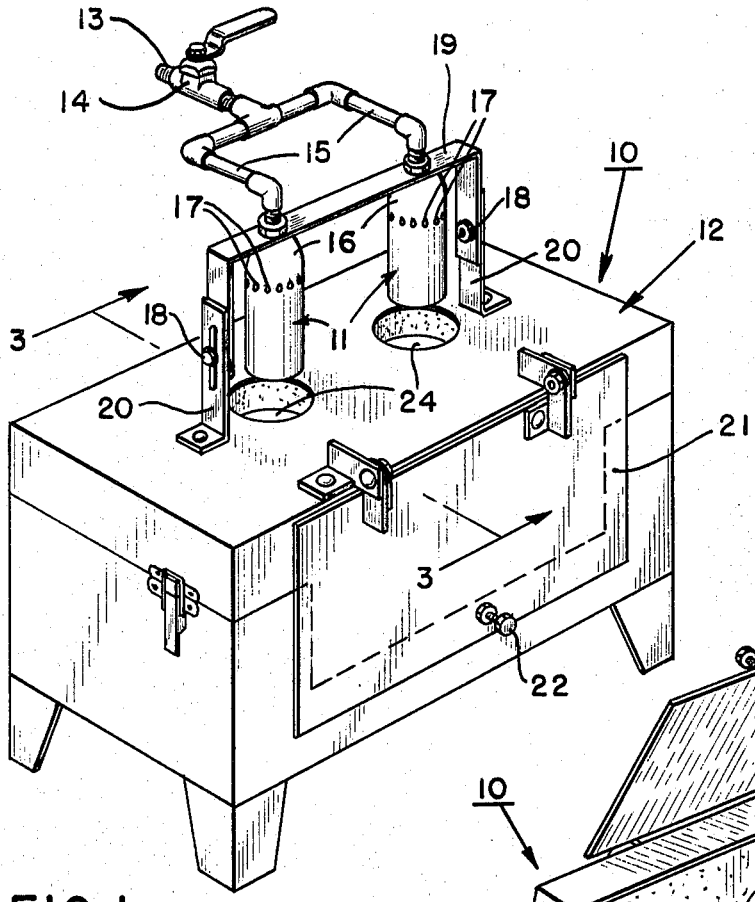
FIG. 1 demonstrates a perspective view of the preferred embodiment of the invention.

For a more detailed description of the invention, forge 10 is shown in FIG. 1 as having a pair of burners 11 positioned above housing 12 and outwardly spaced therefrom. A gas supply source (not shown) which may be propane or natural gas is directed through conduit 13 and is regulated by valve means 14. When valve means 14 is opened gas flows through burner conduits 15 for ignition. Cylindrical cover members 16 define a series of openings 17 which allow air to enter cover members 16 for combustion purposes. Cover members 16 are threadably received on conduits 15 and allow the user to adjust the length of the flame therefrom.

Burners 11 as shown in FIG. 1 are spaced from housing 12 and can be vertically adjusted by the loosening of adjusting means 18 and vertically lowering or raising inserted u-shaped burner support bracket 19 which is slidably joined to housing mount 20.

Figure 2:
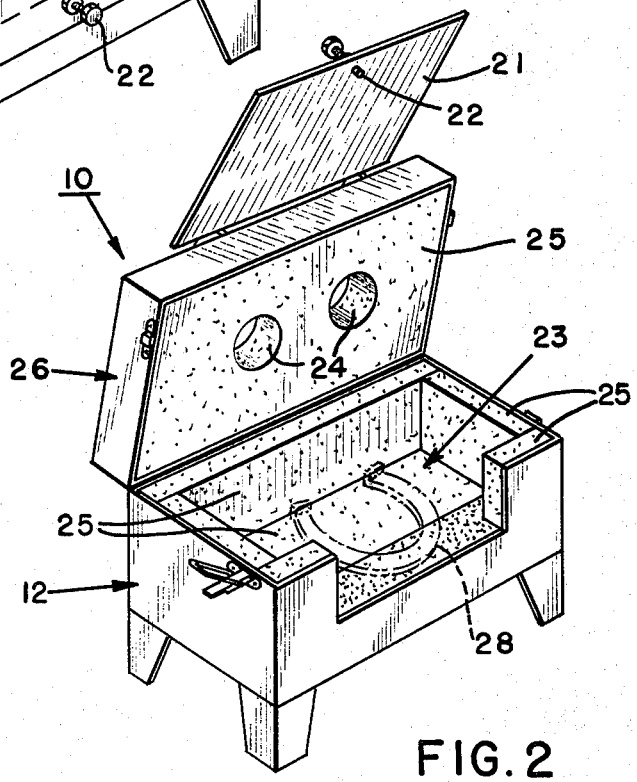
FIG. 2 demonstrates the preferred embodiment in an open configuration without the burners attached thereto.
Figure 3:
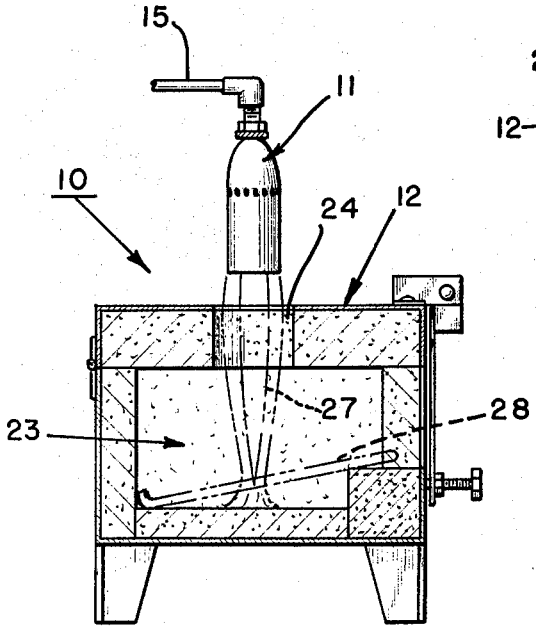
FIG. 3 demonstrates an end cross-sectional view of the forge in operation.

Door means 21 which may be constructed of stainless steel is hingeably attached to housing 12 and is adjustably closable by rotating threaded means 22. Threaded means 22 allows the blacksmith to regulate the amount of air entering heating chamber 23 as shown in FIGS. 2 and 3. As would be understood forge 24 and housing 12 allow the flames from burners 11 to enter heating chamber 23.

As shown in FIG. 2 housing 12 of forge 10 is totally insulated inside with a fire resistant material 25 to conserve heat and gas fuel and forge 10 may have a housing with a hingeable lid 26 which can be opened for cleaning or maintenance purposes.

In the cross-sectional view of forge 10 as shown in FIG. 3, the spacing of burner 11 and housing 12 is apparent and as shown, the hotter inner flame 27 from burner 11 is adjusted to touch object 28 thereby causing object 28 to rapidly heat to its optimum temperature for forming. This rapid heating allows forge 10 to operate in a quick and efficient manner providing time and fuel savings for the user. Comparison tests have shown the oven of the present invention to use approximately one and one half pounds of propane gas which during the same period of time competitive forges of the same approximate size consume five to six pounds of propane.

Various modifications and changes can be made to the present invention without departing from its scope and the examples and illustrations shown herein are for illustrative purposes and are not intended to limit the invention.

I claim:

1. A forge comprising: a housing, a heating chamber within said housing, said housing defining an opening, a gas burner, said burner being outwardly, openly spaced from said housing opening, a door means, said door means being hingeable and adjustably closable, said burner for directing a flame from said burner through the open space between said burner and said housing opening and through said housing into said heating chamber.

2. A forge as claimed in claim 1 and including a plurality of gas burners.

3. A forge as claimed in claim 2 and having an opening for each of said plurality of gas burners.

4. A forge as claimed in claim 1 wherein said burner includes a perforated cylindrical cover member.

5. A forge as claimed in claim 1 wherein said gas burner is adjustably spaced from said opening.

6. A forge comprising a housing, a heating chamber within said housing, said housing defining a plurality of openings along its top, a plurality of burners, said burner being outwardly, openly spaced from said housing openings, a door means, said door means being hingeably mounted to said housing, a substantially u-shaped bracket means, said bracket means for adjustably spacing said burners from said housing openings, said burners for directing flames from said burners through the open space between said burners and said housing openings and through said housing into said heating chamber.

* * * * *